US007488880B2

(12) United States Patent
Batio

(10) Patent No.: US 7,488,880 B2
(45) Date of Patent: Feb. 10, 2009

(54) STRING DAMPENER FOR A STRINGED MUSICAL INSTRUMENT

(75) Inventor: Michael Batio, Kenosha, WI (US)

(73) Assignee: M.A.C.E. Music, Gumee, IL (US)

( * ) Notice: Subject to any disclaimer, the term of this patent is extended or adjusted under 35 U.S.C. 154(b) by 279 days.

(21) Appl. No.: 11/219,494

(22) Filed: Sep. 2, 2005

(65) Prior Publication Data

US 2007/0051224 A1 Mar. 8, 2007

(51) Int. Cl.
*G10D 3/00* (2006.01)

(52) U.S. Cl. ..... 84/318; 84/267

(58) Field of Classification Search ..... 84/318, 84/315–317, 319, 267, 312 R
See application file for complete search history.

(56) References Cited

U.S. PATENT DOCUMENTS 2,628,524 A * 2/1953 Eps ..... 84/267
3,011,380 A 12/1961 Brimhall
3,427,916 A * 2/1969 Fender ..... 84/267
3,440,917 A 4/1969 Lemon
3,797,355 A 3/1974 Law
3,956,962 A 5/1976 Fields
3,971,287 A 7/1976 Ito
3,994,196 A 11/1976 Hamil
4,116,107 A 9/1978 Rickard
4,363,256 A * 12/1982 Smith ..... 84/317
4,753,147 A 6/1988 Berardi
5,347,906 A 9/1994 Geiger
5,467,679 A * 11/1995 Schmidt ..... 84/312 R
5,497,690 A 3/1996 Soupios
6,452,077 B1 9/2002 Chapman et al.
6,521,820 B1 * 2/2003 Patel ..... 84/318

OTHER PUBLICATIONS

Batten, J., webpages entitled "String Dampener Museum" from website www.jenniferbatten.com, web published Jan. 2006.

* cited by examiner

*Primary Examiner*—Walter Benson
*Assistant Examiner*—Jianchun Qin
(74) *Attorney, Agent, or Firm*—Patrick B. Law

(57) ABSTRACT

A string dampener for a musical instrument is disclosed for dampening extraneous string noise caused by sympathetic vibrations. The dampener includes an attachment apparatus that releaseably attaches the dampener to a portion of a stringed instrument. The dampener also includes dampening material to dampen string vibrations. An arm section is included that is rotatably coupled to the attachment apparatus and has the dampening material disposed on at least a portion of the arm section. The arm section is used to selectively engage and disengage contact of the dampening material with one or more strings of the stringed instrument by rotation with respect to the attachment apparatus. The string dampener affords quick attachment and detachment from a stringed instrument as well as easy engagement and disengagement of the dampener with the strings of an instrument with a requisite amount of pressure on the strings to effect proper dampening of sympathetic vibrations.

16 Claims, 5 Drawing Sheets

STRING DAMPENER FOR A STRINGED MUSICAL INSTRUMENT

TECHNICAL FIELD

The present application relates to a string dampener for a stringed musical instrument, and more particularly to a string dampener that is detachably mountable to the stringed musical instrument.

BACKGROUND

When using stringed musical instruments, such as guitars, bass guitars, mandolins, banjos, etc., different tonal effects are desired for different styles of music and different techniques of play. For example, it is known to use a "hammering" technique where a player produces tones by fingering various notes on a fingerboard (e.g., a fret board) without strumming or plucking the strings with the other hand at or near a body of the instrument. When playing in such a manner, however, especially with electrically amplified musical instruments, extraneous or "sympathetic" vibrations of other "open" strings can occur, resulting in unwanted noise or frequencies being produced. In order to mitigate or prevent these sympathetic vibrations, various devices are known in the art to dampen such extraneous noise.

In particular, string dampeners are known for limiting the string vibrations initiated by a musician's hands. Essentially, the purpose of string dampeners is to purify all musical notes by eliminating unwanted or extraneous sounds which can occur because of sympathetic vibrations. It is noted here that string dampeners are different from other devices known in the art such as string mutes, which are typically attached at an instrument's body, such as near a bridge device for a guitar, bass or banjo, as examples. The purpose of the mute is not for eliminating unwanted sounds, but rather to change the timbre of the sound, such as to produce a staccato sound or a muted note.

Because even with clean, direct fingering by the musician, sympathetic vibrations in the strings not touched occurs near the neck of a stringed instrument, string dampeners are typically placed near the nut of a guitar, for example, to prevent vibrations in the untouched strings. One known apparatus is simply a strip of felt or other dampening material that is permanently attached to the fingerboard, lying under the strings at the 1st fret. This apparatus, however, is not easily removable and requires both of the musician's hands to remove or adjust the apparatus.

For stringed instruments such as guitars, bass guitars, mandolins, etc., another string dampener is also known that is a mechanical attachment with a base that is screwed or glued to the headstock of the guitar or other stringed instrument and a post attached to the base. An arm is pivotally attached to the post and includes a piece of dampening material that is placed against the string to achieve limited damping of the string by rotating the arm with respect to the base. Such a device, however, requires adhesive or some other means such as screws to secure the device to the instrument, and thus leaves an ugly scar or adhesive mark when the device is removed. Additionally, such a device is not quickly removable as the device is essentially a permanent fixture. Thus, removal of such a device is time consuming, laborious and requires either the use of tools or solvents.

SUMMARY

According to an example, a string dampener for use with a musical instrument includes an attachment apparatus configured to releaseably attach the string dampening apparatus to a portion of a stringed instrument. The dampener also includes dampening material configured to dampen string vibrations. Finally, an arm section is included that is rotatably coupled to the attachment apparatus and also having the dampening material disposed on at least a portion of the arm section, the arm section being configured to selectively engage and disengage contact of the dampening material with one or more strings of the stringed instrument. These and other features of the disclosed string dampener afford quick attachment and detachment from a stringed instrument as well as easy engagement and disengagement of the dampener with the strings of an instrument with a requisite amount of pressure on the strings to effect proper dampening of sympathetic vibrations.

DETAILED DESCRIPTION

Figure 1:
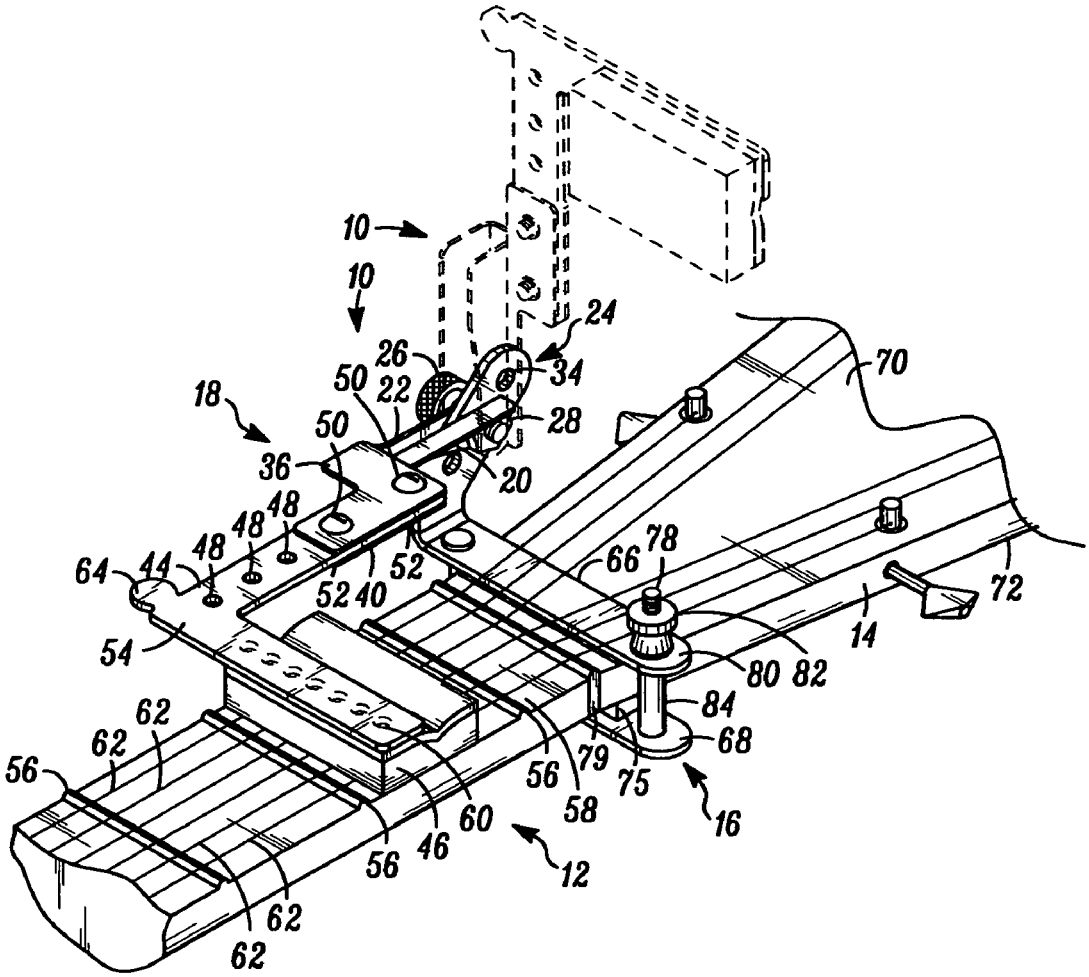
FIG. 1 illustrates a perspective view of an exemplary string dampening apparatus according to the present application as attached to a stringed instrument such as a guitar.

FIG. 1 illustrates a perspective view of a string dampening apparatus 10 that is attached to a stringed instrument 12, such as a guitar. As shown, the dampening apparatus is connected to the instrument 12, such as at a head stock 14 of the instrument 12, with a clamping apparatus 16 that clamps or attaches in some similar manner around a portion of the instrument 12 (e.g., the head stock 14). The clamping apparatus, which will be discussed in more detail to follow, is specifically configured to releasably attach the dampening apparatus 10 to the instrument 12. This affords ease of attachment, allowing the dampening apparatus 10 to be easily and quickly attached or detached from the instrument 12. Additionally, this affords attachment of a string dampener to the instrument without the need to permanently affix the dampener, which is undesirable, as discussed previously in the background.

Figure 5:
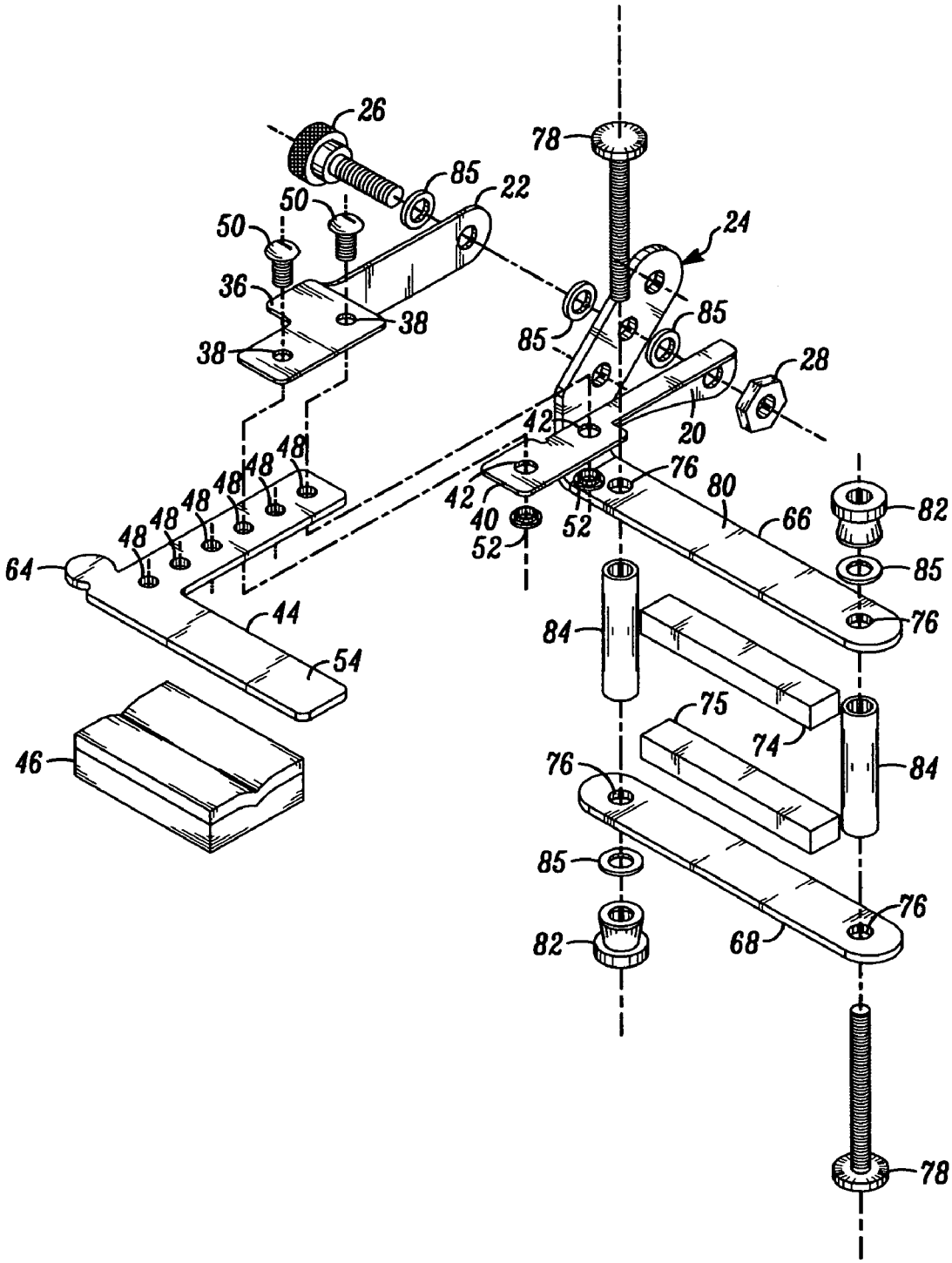
FIG. 5 illustrates a perspective assembly diagram of the string dampening apparatus of FIG. 1.

Dampening apparatus 10 also includes an arm section 18 that is rotatably coupled to the clamping apparatus 16. In this disclosed example, the arm section 18 is "L" shaped and includes various pieces. These pieces include lower and upper extension arms 20 and 22, which are joined at their proximal ends to a vertically protruding portion 24 of the attachment apparatus 16. Holes (30 and 32 as shown in FIG. 5) located in the lower and upper extension arms 20, 22 align with one of a plurality of holes 34 in the vertically protruding portion 24 of the attachment apparatus 16 and are secured thereto with a partially threaded screw 26, such as a knurled thumb screw, engaged through the holes (30, 32, 34) and fastened with a threaded nut 28, such as a lock nut. By joining the arms 20, 22 to the protruding portion 24 with a screw 26 and lock nut 28 (or similar device), the arm section 18 can pivot with respect to attachment apparatus 16.

It is noted that the arm section 18 may be attached by the screw 26 and threaded nut 28 to the vertically protruding portion 24 using any of the plurality of holes 34 in the vertically protruding portion 24. This allows the arm section 18 to be adjusted to varied heights and varied reaches of the arm to accommodate different instruments or achieve different tonal effects. The threaded nut 28, as mentioned above, may be a lock nut that is used to ensure that, after tensioning the nut to a desired tension, the selected tension is set to ensure that a constant and appropriate level of tension can be applied to the strings of an instrument by the dampener 10. One of ordinary skill in the art will appreciate that the level of tension could also be adjustable by a user by using a normal threaded nut, for example. Additionally, one of ordinary skill in the art will appreciate that any one of a number of various devices having an equivalent function to a screw and threaded nut may be utilized to pivotally connect the arm portion 18 to the attachment apparatus 16 as well as provide tension.

As discussed above, the arm section 18 includes lower and upper extension arms 20, 22 that connect to the attachment apparatus 16 at their proximal ends. At the distal end of the upper extension arm 22 is a widened portion 36 having one or more holes (38 as shown in FIG. 5). The lower extension arm 20 also includes a horizontal section 40 having one or more holes (42 as shown in FIG. 5). As shown in FIG. 1, the arm section 18 includes an "L-shaped" extension arm 44 that serves to extend the reach of the arm section 18 and also hold a dampening material 46. The L-shaped extension arm 44 connects to the lower and upper extension arms 20, 22 by placement between the widened portion 36 and the horizontal section 40. A plurality of holes 48 within the L-shaped extension arm 44 are configured to align with the holes 32, 34 in the lower and upper extension arms 20, 22, respectively. The extension arm 44 is affixed to extension arms 20, 22 with a fastening device, such as a screws 50 and complementary flanged nuts 52. By including a plurality of holes 48 in the L-shaped extension arm 44, the reach of the arm section 18 is adjustable.

It is noted that one skilled in the art will appreciate that various other ways of constructing the arm section 18 may be contemplated. For example, the arm section 18 may be a singular piece, rather than being constructed of a number of pieces. Additionally, the means for adjusting the reach of the arm (e.g., the plurality of holes 48 matching with holes in the extension arms 20, 22) may instead have other constructions such as a telescoping arm, and the means for securing the movable portions such as the L-shaped extension arm 44 (e.g., screws 50 and flanged nuts 52) may instead include any other suitable structure afford ease of disconnection or loosening to allow adjustment of the arm with respect to other portions of the arm section 18.

Dampening material 46 is attached to a portion 54 of L-shaped extension arm 44, which is oriented approximately parallel to frets 56 on the finger board 58 of the instrument 12. The dampening material 46 may be constructed of any material sufficient to dampen vibration of the strings 62 of the instrument 12. As examples, the material 46 may be constructed from felt, such as piano felt, or foam rubber. Additionally, although the drawings illustrate the material 46 in a monolithic shape, any number of various shapes are contemplated that will sufficiently engage with the strings 62 to achieve dampening. Moreover, although the drawings illustrate that the dampening material 46 engages with all of the strings 62 of the instrument 12, the material could be shaped and constructed such that it only engages a number of the strings 62 less than the total amount of strings.

Dampening material 46 may be affixed to the underside of portion 54 with an adhesive. Alternatively, the portion 54 could include one or more holes 60, shown dashed, through which could be used to stitch or affix the material 46 in some other suitable way. Additionally, the dampening material 46 also could include an attached sleeve of material (not shown), which is appropriately sized and configured to engage around the portion 54. One of ordinary skill in the art will appreciate that many different suitable ways to attach the dampening material 46 to the arm 18 could be envisioned.

Figure 3:
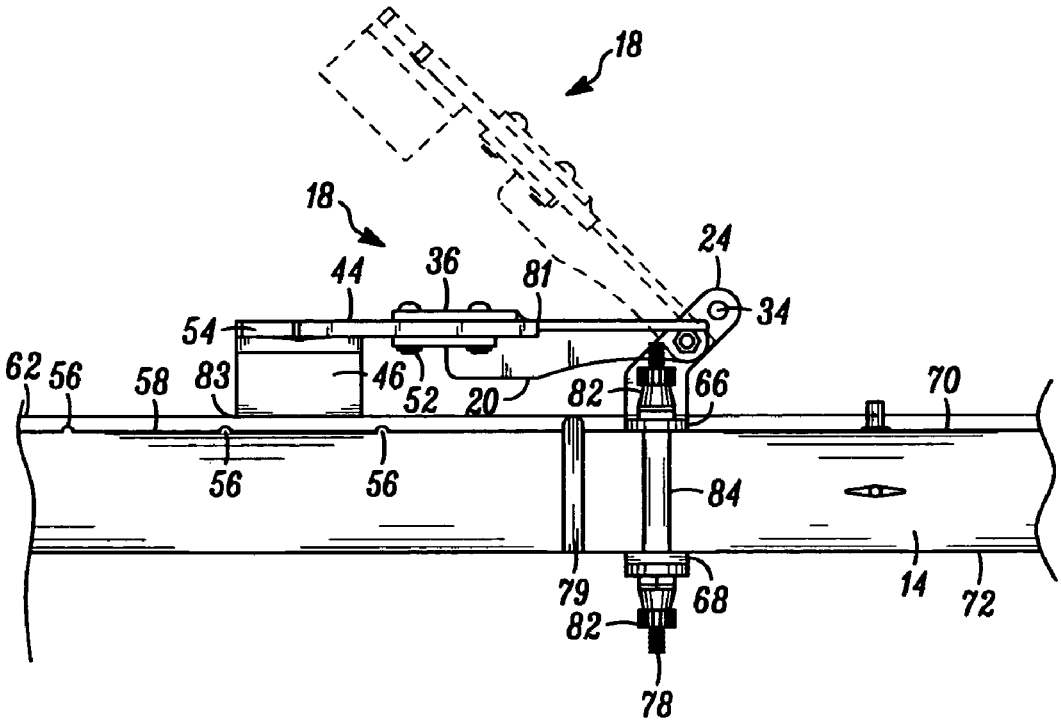
FIG. 3 illustrates a fragmentary side elevation view of the string dampening apparatus taken upon on the line 3-3 of FIG. 2.

The L-shaped extension arm 44 may also include a handle or finger piece 64 that allows a user to more easily engage and disengage the arm section 18 such the dampening material is brought into engagement or taken out of engagement with the strings 62. As illustrated in FIGS. 1 and 3 the disengaged position of the arm section 18 is illustrated with dashed lines.

Turning to the attachment apparatus 16, the example illustrated includes first and second brackets such as an upper bracket 66 and a bottom bracket 68 that respectively engage with a top side 70 and a bottom side 72 of the headstock 14. These brackets may be seen in FIGS. 1-5. On those surfaces of the brackets that engage with the headstock, pieces of foam rubber 74 and 75 may be affixed thereto in order to protect the finish of the instrument, as well as ensure proper force and positioning on headstocks not having parallel top and bottom sides 70, 72 as may be seen in FIGS. 3 and 4. Each of the brackets 66 and 68 include holes 76 at each end portion of the brackets that receive a threaded screw 78 used to join the brackets 66 and 68 together around the head stock 14. Also, the upper bracket 66 may be a single piece member that includes the vertically protruding portion 24 that essentially extends vertically at a 90° angle as shown or some other angle, either acute or obtuse, from a horizontal portion 80 of the upper bracket 66. The horizontal portion 80, as shown, engages with the top side 70 of the headstock 14 underneath the strings 62 behind a "nut" 79 of the instrument 12, thus not interfering with the strings 62 or the fret board 58. The threaded screws 78 may have a flat head and the holes 76 includes a bezel or partial bore such that the heads of the screws are flush or level with a surface of the brackets 66, 68. The screws 78 at the different ends of the brackets 66, 68 are shown oriented 180° from one another, but may alternatively be oriented the same direction.

When screws 78 are engaged in the holes 76 of each of the brackets 66, 68, the attachment assembly 16 is then secured with complementary threaded nuts 82, which may be knurled for ease of turning by hand. By screwing the nuts 82, the attachment assembly 16 is securely attached to the instrument. This arrangement also permits ease of detachment of the dampening apparatus 10 from the instrument 12.

Figure 2:
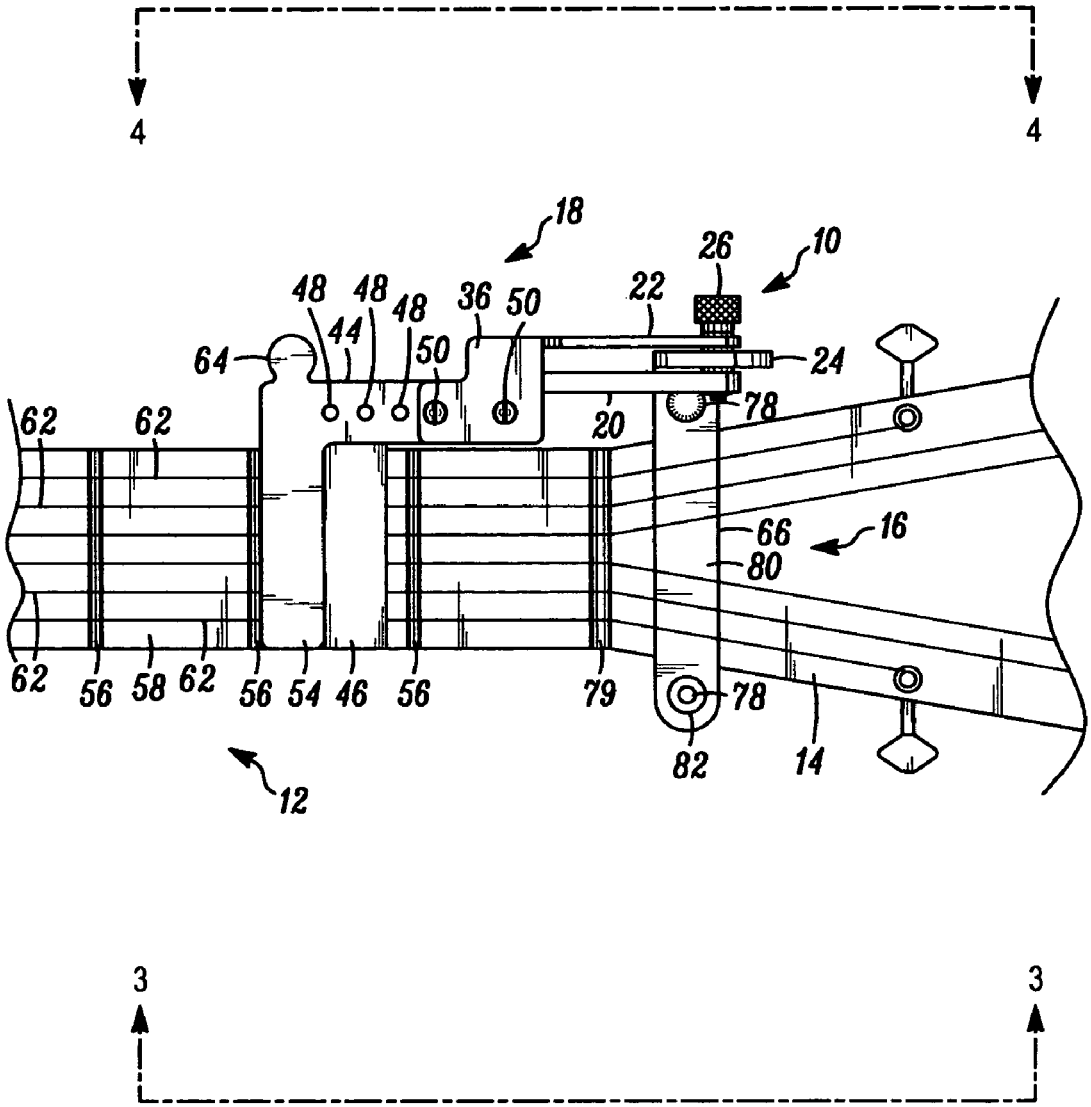
FIG. 2 illustrates a top plan elevation view of the string dampening apparatus of FIG. 1.

FIG. 2 illustrates a top plan elevation view of the string dampening apparatus 10 as attached to the stringed instrument 12. As shown, the arm section 18 is engaged with the strings 62 in order to effect dampening of the strings. This view illustrates the disposal of the lower and upper extension arms 20, 22 on respective sides of the vertically protruding portion of upper bracket 66.

FIG. 3 illustrates a fragmentary side elevation view of the string dampening apparatus 10 taken upon on the line 3-3 of FIG. 2 as engaged with an instrument 12. As illustrated, when the arm section 18 is engaged in a position for performing string dampening, a bottom surface 83 of the dampening material 46 engages or touches the strings 62. Preferably, the arm portion is tensioned sufficiently with the thumb screw 26 to maintain a measure of tension of the bottom surface 83 of the dampening material 46 against the strings 62 to ensure optimal dampening of the strings. 62. FIG. 3 additionally illustrates that the L-shaped arm 44 adjusted with respect to the lower and upper extension arms 20 (and 36 as the visible portion of upper extension arm 22) so that the material 46 engages with the strings closer to the nut 79. A portion 81 of the arm 44 can be seen extending past the widened portion 36 of the upper extension arm 22 illustrating this adjustment.

Figure 4:
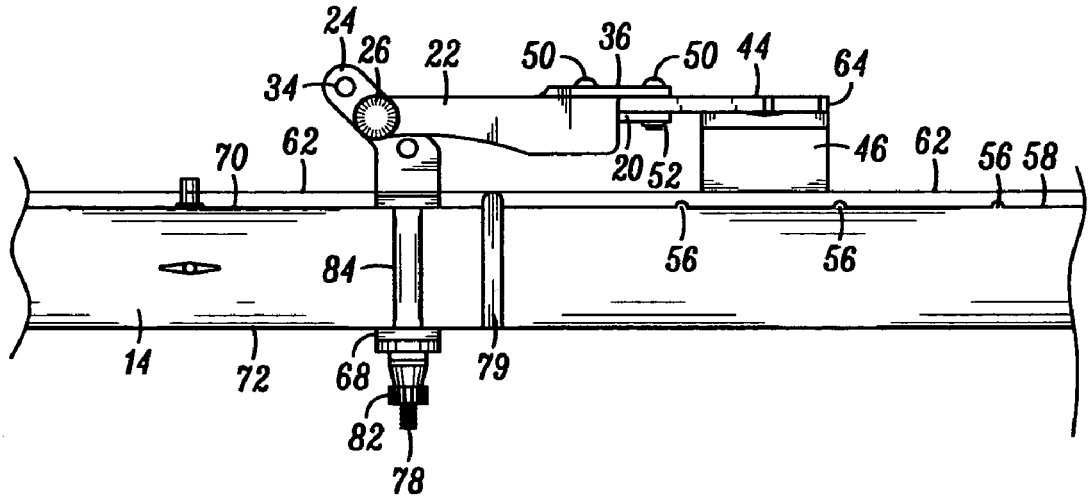
FIG. 4 illustrates a fragmentary side elevation view of the string dampening apparatus taken upon on the line 4-4 of FIG. 2.

FIG. 4 illustrates a fragmentary side elevation view of the string dampening apparatus 10 taken upon on the line 4-4 of FIG. 2 as engaged with an instrument 12. Here the arm 18 is shown in an engaged position such that the dampening material 46 is engaged with the strings 62.

FIG. 5 illustrates an assembly diagram of an exemplary construction of the disclosed string dampening apparatus. From this view, it can be seen that the bracket screws 78 may be constructed to have a flat head such that head can seat as unobtrusively as possible on surfaces of the upper and bottom brackets 66, 68. These surfaces may also include a bezel or sink such the top surfaces of the head of the screws 78 may be flush with these surfaces. Additionally, this figure illustrates sleeves 84 that surround the screws 78 for that portion of the screws 78 between the upper and lower brackets 66, 68 that could potentially come into contact with finished surface of the instrument. These sleeves may be cylindrical as shown and constructed of any suitable material that will not damage the finish of the stringed instrument, such as plastic or rubber.

FIG. 5 also illustrates the foam rubber pads 74, 75 that may be respectively affixed to those surfaces of the upper and bottom brackets 66, 68 that face surfaces of the instrument. The material of pads 74, 75 may include any suitable material that will not damage the finish of the stringed instrument. Moreover, various washers 85 are illustrated being placed around various screws in this particular example.

When attaching the dampener 10 to the instrument 12, the upper bracket 66 is inserted underneath the strings 62 at the head stock 14 of the instrument as may be seen in FIGS. 1-4. The bottom bracket 68 is then positioned on the bottom side of the headstock 14 and the screws 78 of each of the brackets 66, 68 aligned with the corresponding holes 76 in the other of the brackets 66, 68. The thumb screws 82 are then screwed onto the screws 78 and tightened to secure the attachment apparatus 16 to the head stock 14 of the instrument 12.

Concerning engagement of the dampening material 46 with the strings 62 to effect dampening, the arm portion 18 is simply rotated until the dampening material is pressed down onto the strings 62 with suitable pressure to ensure proper dampening. The handle or finger piece 62 is helpful to provide a portion of the arm portion 18 for the user to grab for engaging and disengaging the arm portion 18 with one hand.

Figure 6:
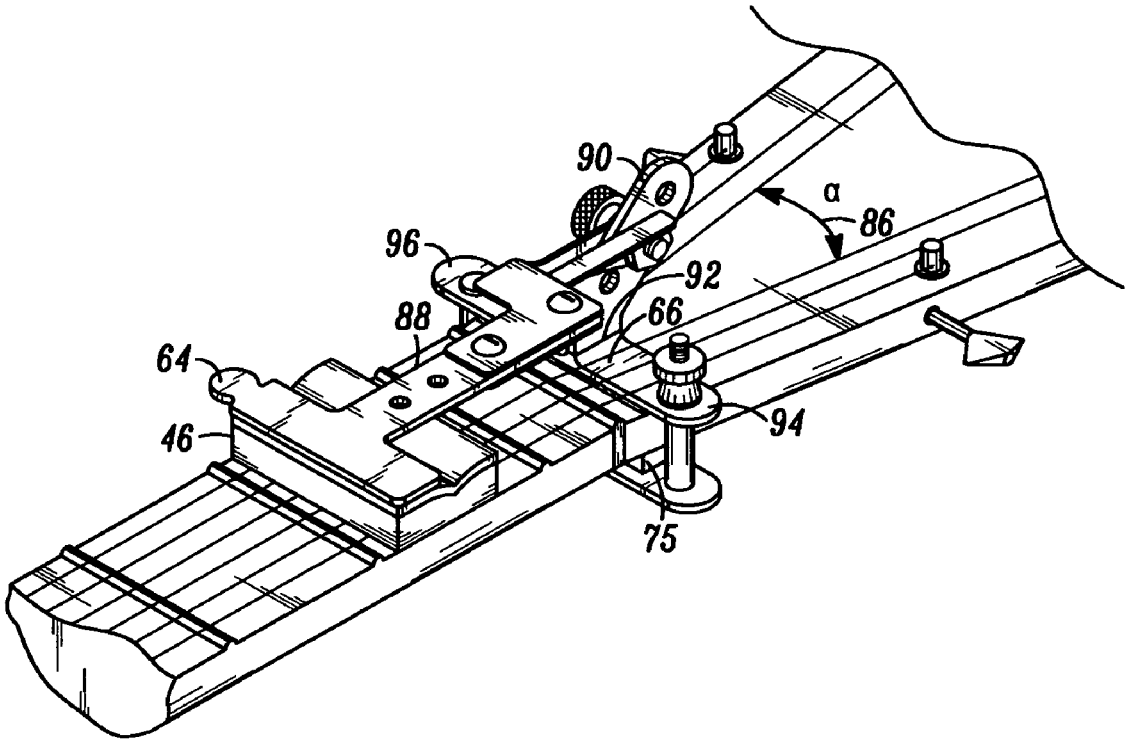
FIG. 6 illustrates a perspective view of another exemplary string dampening apparatus according to the present application having a T-shaped arm as attached to a stringed instrument.

FIG. 6 illustrates a perspective view of another exemplary string dampening apparatus according to the present application having a T-shaped arm as attached to the stringed instrument. In this example, same reference numbers are used as with the previous example to denote similar parts. As shown, the string dampening apparatus in the example of FIG. 6 includes a T-shaped arm 88 to more uniformly distribute force or tension on the strings with the dampening material 46. The arm 88 may be pivotally attached to a vertical protruding portion 90 extending from the upper bracket 66. This vertical protruding portion 90 extends approximately vertical from a center portion of the upper bracket 66 that lies between center strings of the instrument that separate at some angle a labeled with reference number 86. The vertical protruding portion 90 may have a unitary construction with the upper bracket 66. In such case, the apparatus would have to be attached to the instrument prior to stringing of the instrument since the bracket 66 would not be able to pass underneath the strings as in the example of FIGS. 1-5.

Alternatively, the vertical protruding portion 90 could be a separate piece from the upper bracket 66 that is affixed to bracket 66 after the bracket is attached to the instrument. A means of attaching 92 is shown in the figure simply as a line, which indicates a junction between the portion 90 and the upper bracket 66. This means of attaching 92 could be any number of devices, such as a hinge, where the protruding portion 90 may be rotated downward toward the upper bracket 66 when being inserted underneath the strings during attachment and then rotated to a vertical position for attachment of the arm 88. Alternatively, the portion 90 could have at least one tab, hooked tab, or slot in the surface abutting the bracket 66 that mates with a complementary slot, tab or hooked tab in the bracket 66 in order to secure the portion 90 to the bracket 66. It is noted that one of ordinary skill in the art will appreciate that the means of attaching 92 may be any suitable device or devices allowing the protruding portion 90 to be either movable or removable to allow the upper bracket 66 to be attached under the strings of the stringed instrument without removal of the strings themselves. It is also noted that the exemplary dampening apparatus of FIG. 6 is more likely to be used with instruments having a larger angle 86 between the center strings of the instrument to allow for the vertically protruding portion 90 to fit between them the center strings without touching the strings.

In light of the foregoing discussion, the disclosed string dampener affords quick attachment and detachment from a stringed instrument. Additionally, the releasable nature of the attachment apparatus of the dampener affords the ability to connect the dampener without the need for permanent means of affixing the dampener such as adhesive or screws. The pivoting arm of the dampener, which includes a means for tensioning (e.g., a tensioning screw), affords easy engagement and disengagement of the dampener with the strings with a requisite amount of pressure on the strings to effect proper dampening of sympathetic vibrations.

The above-detailed examples have been presented for the purposes of illustration and description only and not by limitation. It is therefore contemplated that the present disclosure cover any additional modifications, variations, or equivalents that fall with in the spirit and scope of the basic underlying principles disclosed above and the appended claims.

What is claimed is:

1. A string dampening apparatus for use with a musical instrument comprising:

an attachment apparatus configured to releaseably attach the string dampening apparatus to a portion of a head stock of a stringed instrument behind a nut of the stringed instrument, the attachment apparatus having a first bracket engageable with a top surface of the head stock and a second bracket engageable with a bottom surface of the head stock;

dampening material configured to dampen string vibrations; and an arm section rotatably coupled to the attachment apparatus and also having the dampening material disposed on at least a portion of the arm section, the arm section being configured to selectively engage and disengage contact of the dampening material with one or more strings of the stringed instrument;

wherein the first bracket includes a vertically extending portion to which the arm section is rotatably coupled.

2. The string dampening apparatus as defined in claim 1, wherein the vertically extending portion extends from an end portion of the first bracket.

3. The string dampening apparatus as defined in claim 1, wherein the vertically extending portion extends from a center portion of the first bracket.

4. The string dampening apparatus as defined in claim 1, wherein the arm section is coupled to the vertically extending portion with a tensioning device that maintains a settable amount of tension resisting rotation of the arm section with respect to the vertically extending portion.

5. The string dampening apparatus as defined in claim 1, wherein the vertically extending portion is configured with a plurality of connection positions to which the arm section may be rotatably connected to the vertically extending portion to allow two or more height adjustments of the arm section with respect to a surface of the instrument.

6. The string dampening apparatus as defined in claim 1 wherein the arm section is configured to be adjustable in reach.

7. The string dampening apparatus as defined in claim 1 wherein the dampening material comprises felt.

8. The string dampening apparatus as defined in claim 1, wherein the arm section has one of an "L" shape and "T" shape.

9. A string dampener for a musical instrument comprising:

an attachment apparatus that releasably attaches the string dampener to a head stock portion of the musical instrument at a portion of the head stock behind a nut of the musical instrument, the attachment apparatus having a first bracket engageable with a top portion of the head stock and a second bracket engageable with a bottom portion of the head stock;

an arm section rotatably coupled to the attachment apparatus; and a dampening material affixed to at least a portion of the arm section, wherein the dampening material is configured to selectively contact with one or more strings of the musical instrument through rotation of the arm section with respect to the attachment apparatus;

wherein the first bracket includes a vertically extending portion to which the arm section is rotatably coupled.

10. The string dampener as defined in claim 9, wherein the vertically extending portion extends from an end portion of the first bracket.

11. The string dampener as defined in claim 9, wherein the vertically extending portion extends from a center portion of the first bracket.

12. The string dampener as defined in claim 9, wherein the arm section is coupled to the vertically extending portion with a tensioning device that maintains a settable amount of tension resisting rotation of the arm section with respect to the vertically extending portion.

13. The string dampener as defined in claim 9, wherein the vertically extending portion is configured with a plurality of connection positions to which the arm section may be rotatably connected to the vertically extending portion to allow two or more height adjustments of the arm section with respect to a surface of the instrument.

14. The string dampener as defined in claim 9, wherein the arm section is configured to be adjustable in reach.

15. The string dampener as defined in claim 9, wherein the dampening material comprises felt.

16. The string dampener as defined in claim 9, wherein the arm section has one of an "L" shape and "T" shape.

* * * * *